US007472791B2

(12) United States Patent
Spivey, Sr.

(10) Patent No.: US 7,472,791 B2
(45) Date of Patent: Jan. 6, 2009

(54) CARRIER WITH HANDLE FLAPS FOR OBSTRUCTING VIEW

(75) Inventor: Raymond Rudolph Spivey, Sr., Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 516 days.

(21) Appl. No.: 11/207,511

(22) Filed: Aug. 19, 2005

(65) Prior Publication Data

US 2007/0039846 A1 Feb. 22, 2007

(51) Int. Cl.
*B65D 75/00* (2006.01)

(52) U.S. Cl. ..... 206/427; 229/117.13; 229/244

(58) Field of Classification Search ..... 206/170, 206/427; 229/117.09, 117.12–117.15, 103.2, 229/240, 242, 243, 244
See application file for complete search history.

(56) References Cited

U.S. PATENT DOCUMENTS

| | | | | |
|---|---|---|---|---|
| 2,383,183 | A | | 8/1945 | Fischer |
| 2,702,144 | A | | 2/1955 | Forrer |
| 3,204,815 | A | | 9/1965 | Weiss |
| 3,334,767 | A | | 8/1967 | Cornelius et al. |
| 3,355,012 | A | | 11/1967 | Weiss |
| 3,381,881 | A | | 5/1968 | Ganz et al. |
| 3,828,926 | A | | 8/1974 | Rossi |
| 4,096,985 | A | | 6/1978 | Wood |
| 4,440,340 | A | | 4/1984 | Bakx |
| 4,545,485 | A | | 10/1985 | Oliff |
| 4,653,686 | A | | 3/1987 | Wood et al. |
| 4,706,876 | A | * | 11/1987 | Wilson ..... 206/427 |
| 4,784,316 | A | | 11/1988 | Crouch |
| 4,802,583 | A | | 2/1989 | Calvert et al. |
| 4,875,586 | A | | 10/1989 | Chaussadas |
| 4,966,324 | A | | 10/1990 | Steel |
| 5,060,792 | A | | 10/1991 | Oliff |
| 5,106,014 | A | | 4/1992 | Miller |
| 5,119,985 | A | | 6/1992 | Dawson et al. |
| 5,222,658 | A | | 6/1993 | DeMaio et al. |
| 5,381,891 | A | | 1/1995 | Harris |
| 5,395,044 | A | * | 3/1995 | Stout ..... 229/117.13 |
| 5,458,234 | A | | 10/1995 | Harris |
| 5,485,915 | A | | 1/1996 | Harris |
| 5,524,756 | A | | 6/1996 | Sutherland |

(Continued)

FOREIGN PATENT DOCUMENTS

| | | |
|---|---|---|
| WO | WO 03/037742 A2 | 5/2003 |

*Primary Examiner*—Luan K Bui
(74) *Attorney, Agent, or Firm*—Womble Carlyle Sandridge & Rice, PLLC

(57) ABSTRACT

First and second handle flaps can at least initially be adjacent to one another, for at least partially obstructing a first handle opening. The first handle flap can pivot at least partially into the interior of the carrier so that the first handle flap at least partially covers, and at least partially conforms to the shape of, a first article within the carrier, whereby the first handle flap at least partially blocks the first article from view. The second handle flap can pivot at least partially into the interior of the carrier so that the second handle flap at least partially covers, and at least partially conforms to the shape of, a second article within the carrier, whereby the second handle flap at least partially blocks the second article from view. The first and second articles are adjacent to one another and proximate the handle opening.

49 Claims, 9 Drawing Sheets

U.S. PATENT DOCUMENTS

| | | | | |
|---|---|---|---|---|
| 5,542,536 | A | 8/1996 | Sutherland | |
| 5,609,251 | A | 3/1997 | Harris | |
| 5,657,864 | A | 8/1997 | Harrelson | |
| 5,682,995 | A | 11/1997 | Sutherland | |
| 5,915,546 | A | 6/1999 | Harrelson | |
| 5,931,300 | A | 8/1999 | Sutherland | |
| 5,996,883 | A | 12/1999 | Bates | |
| 6,484,903 | B2 | 11/2002 | Spivey et al. | |
| 6,715,639 | B2 | 4/2004 | Spivey | |
| 6,766,940 | B2 | 7/2004 | Negelen | |
| 7,093,713 | B2 * | 8/2006 | Sutherland | 206/427 |
| 2003/0080180 | A1 | 5/2003 | Holley, Jr. et al. | |

* cited by examiner

CARRIER WITH HANDLE FLAPS FOR OBSTRUCTING VIEW

BACKGROUND OF THE INVENTION

The present invention generally relates to carriers with handle flaps proximate handle openings, and it also generally relates to obstructing pricing bar codes, or the like, from view, with the bar codes being on articles carried by the carriers.

It is conventional for carriers such as cartons to include handle openings in their top panels so that a user can insert their fingers into the handle openings for convenient carrying. For example, U.S. Pat. Nos. 6,484,903, 6,578,736 and 6,715,639 disclose cartons with "racetrack" handles.

It is also conventional for cartons to contain articles, such as containers of food or beverages, so that they can be sold in relatively large multi-container packages (e.g., twelve packs, eighteen packs and twenty-four packs). It is further conventional for the same articles to be sold individually or in relatively small multi-container packages (e.g., six packs) that do not include cartons. Each article is normally marked with a pricing bar code to enable it to be optically scanned and automatically checked out at a retail outlet when sold individually or in a relatively small multi-container package. When a group of the articles is sold in a relatively large multi-container package and is therefore packaged in a conventional carton marked with a pricing bar code, an error can occur if the scanner sees the pricing code on one of the articles and uses that as the price for the package.

For the foregoing and other reasons, there is a need for carriers, such as cartons with handle flaps, that provide a new balance of properties.

BRIEF SUMMARY OF SOME ASPECTS OF THE INVENTION

One aspect of the present invention is the provision of a carrier that is for carrying articles and at least partially blocking the articles from view, and more specifically for at least partially blocking the articles' pricing bar codes, or the like, from view. The carrier can include at least one panel that at least partially defines an interior of the carrier, with the interior being for at least partially containing the articles. The carrier can further include first and second handle flaps that can at least initially be adjacent to one another, for at least partially obstructing a first handle opening in the panel. In addition, the first and second handle flaps can be pivoted at least partially into the interior of the carrier to at least further expose the first handle opening and at least partially block the articles from view.

More specifically and according to one aspect of the present invention, the first handle flap can pivot at least partially into the interior of the carrier so that the first handle flap at least partially covers, and optionally also at least partially conforms to the shape of, a first article within the carrier. As a result, the first handle flap at least partially blocks the first article from view. Similarly, the second handle flap can pivot at least partially into the interior of the carrier so that the second handle flap at least partially covers, and optionally also at least partially conforms to the shape of, a second article within the carrier. As a result, the second handle flap at least partially blocks the second article from view. The first and second articles are adjacent to one another and proximate the handle opening.

In accordance with one aspect of the present invention, the carrier can further include third and fourth handle flaps that are respectively like the first and second handle flaps. For example, the third and fourth handle flaps can respectively pivot at least partially into the interior of the carrier to at least further expose a second handle opening in the panel, and to respectively at least partially cover the first and second articles within the carrier. A handle can be positioned between the first and second handle openings, with each of the first and second handle openings being adjacent the handle. The panel can include first and second panels that are at least partially overlapping with respect to one another, and the handle can be a multi-ply handle.

In accordance with one aspect of the present invention, for each handle flap, the handle flap includes at least one fold line positioned between an edge of the handle flap and the pivotable connection between the handle flap and the panel. The fold is for allowing a first portion of the handle flap to be pivoted relative to a second portion of the handle flap and farther into the interior of the carton than the second portion of the handle flap. As a result and for example, the edges of the first and second handle flaps can be at least partially pivoted away from one another. As another example, a handle flap's fold line can enhance its ability to conform to the shape of the article it covers. For each handle flap, its fold line can be parallel with respect to, or oblique with respect to, the handle flap's edge.

With respect to one aspect of the present invention, the articles at least partially contained in the carrier can be containers having walls respectively extending around the container's axes, and the container's axes extend in a lateral direction. Each pair of handle flaps (e.g., a pair consisting of the first and second handle flaps) can extend in a longitudinal direction that is crosswise with respect to the lateral direction and each pair of handle flaps has an overall length that extends in the longitudinal direction. The edges of the handle flaps, which respectively pivot away from one another during opening of the handle flaps, extend at least generally in the lateral direction. Each pair of handle flaps has a width that extends in the lateral direction. The overall length of each pair of handle flaps can be greater than its width.

In accordance with one aspect of the present invention the, carrier can be constructed from a blank having a panel that includes at least the first and second handle flaps. In one example, this panel can be the first panel in a series of foldably connected panels, and the last panel in the series can include the third and fourth handle flaps. The first and last panels can at least partially overlap with respect to one another in the erected carton, to form a multi-ply handle between the first and second handle openings. Optionally, the last panel in the series can be a reinforcing panel so that the handle is a three-ply handle.

Other aspects and advantages of the present invention will become apparent from the following.

BRIEF DESCRIPTION OF THE DRAWINGS

Reference is made in the following to the accompanying drawings, which are illustrative of exemplary embodiments of the present invention and are not necessarily drawn to scale, and wherein.

DETAILED DESCRIPTION OF EXEMPLARY EMBODIMENTS

Referring now in greater detail to the drawings, in which like numerals refer to like parts throughout the several views, exemplary embodiments of the present invention are described in the following.

Figure 1:
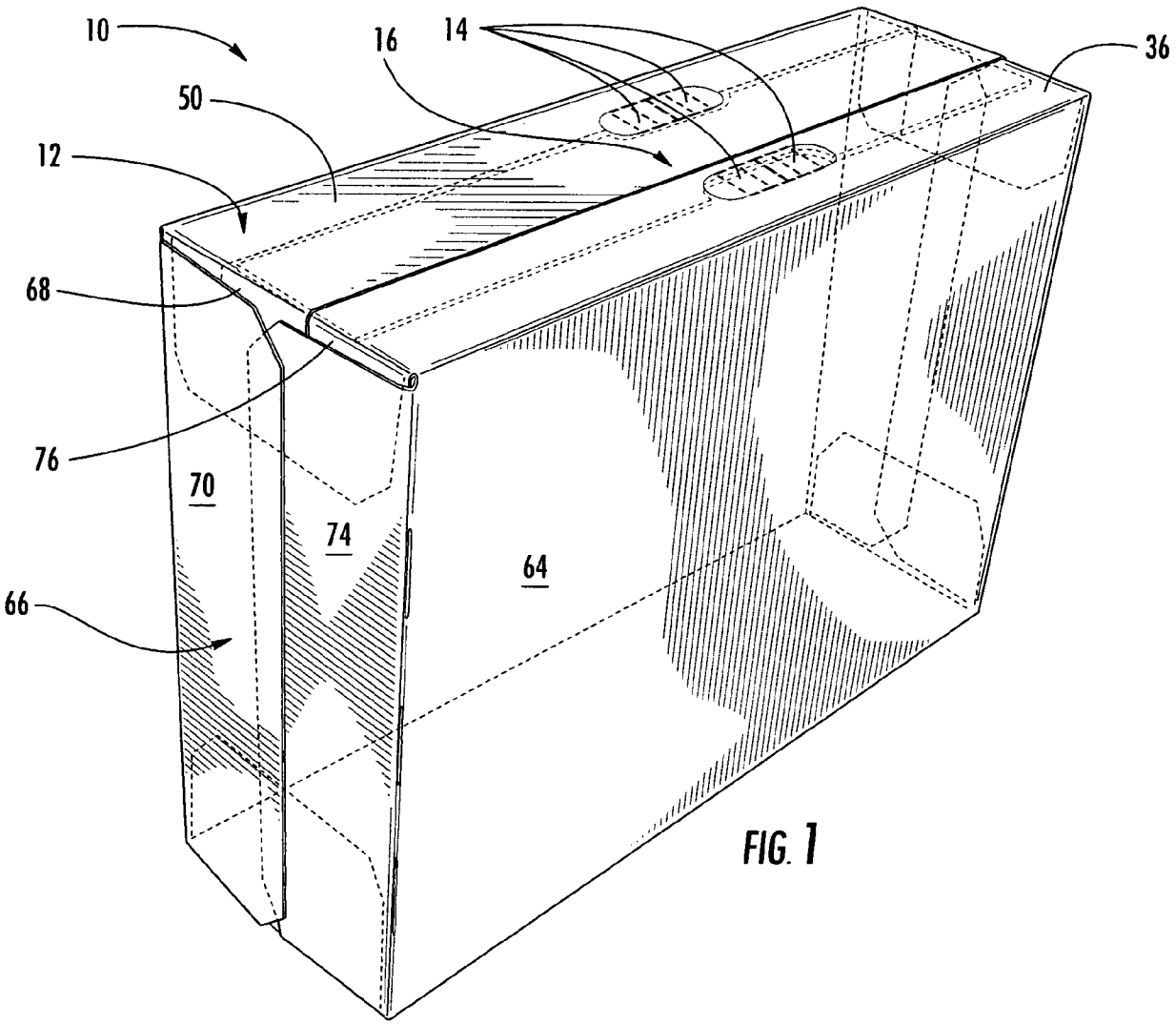
FIG. 1 is a schematic pictorial view of a carton with handle flaps, in accordance with a first embodiment of the present invention.

A carrier of a first embodiment of the present invention is in the form of a carton that is designated by the numeral 10. As best understood with reference to FIG. 1, the carton 10 is at least generally in the form of a parallelepiped, and it includes a composite (e.g., at least partially multi-ply) top panel 12 having a pair of handle flaps 14 on each side of a composite (e.g., at least partially multi-ply) handle 16. In accordance with an alternative embodiment of the present invention, the top panel 12 and the handle 16 are a single ply. FIG. 1 is schematic because, for example, some of the portions of the carton 10 which would otherwise be hidden from view are shown in broken lines.

Figure 2:
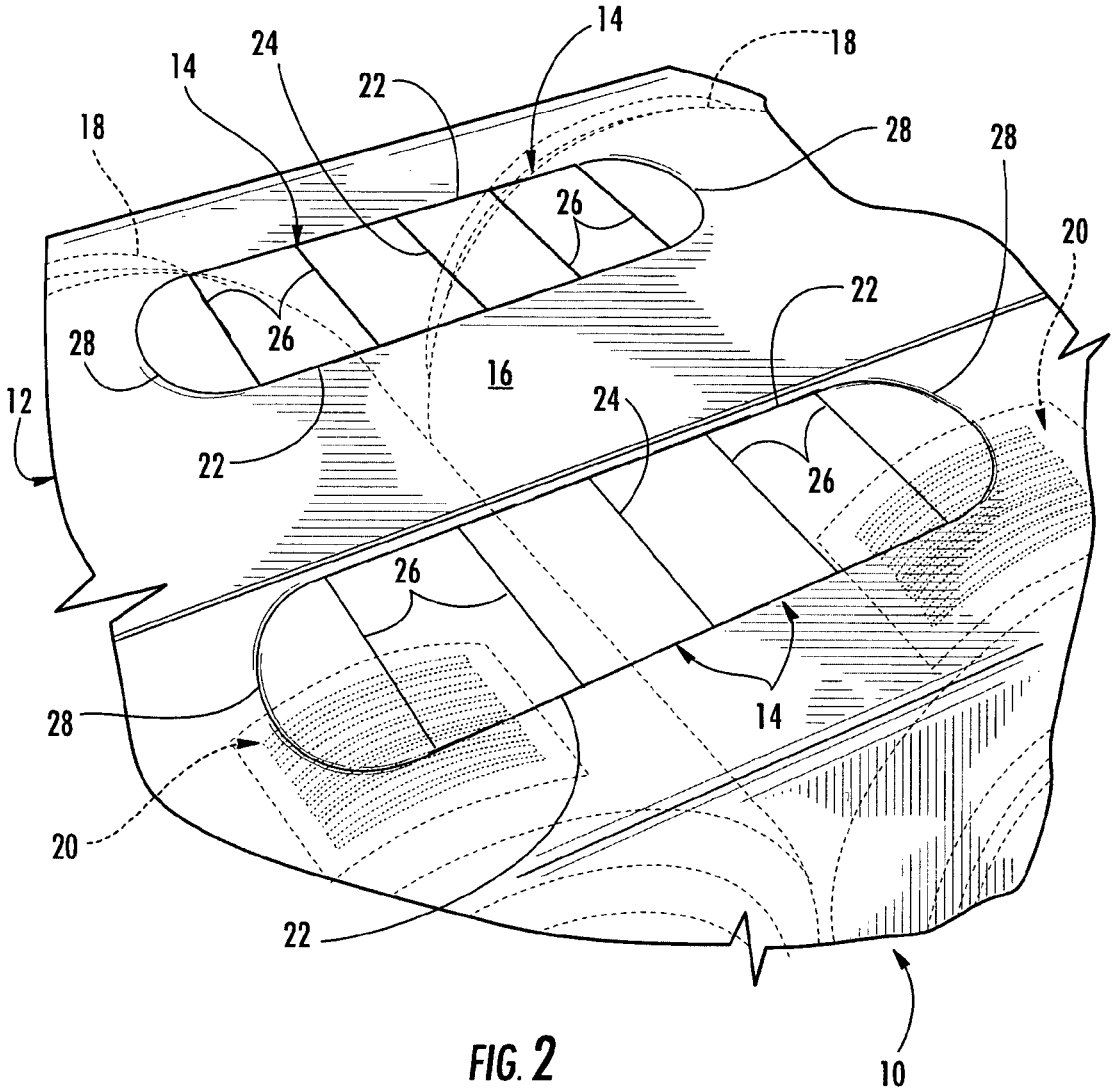
FIG. 2 is a schematic pictorial view of a portion of the carton of FIG. 1, with the handle flaps in a closed configuration.
Figure 3:
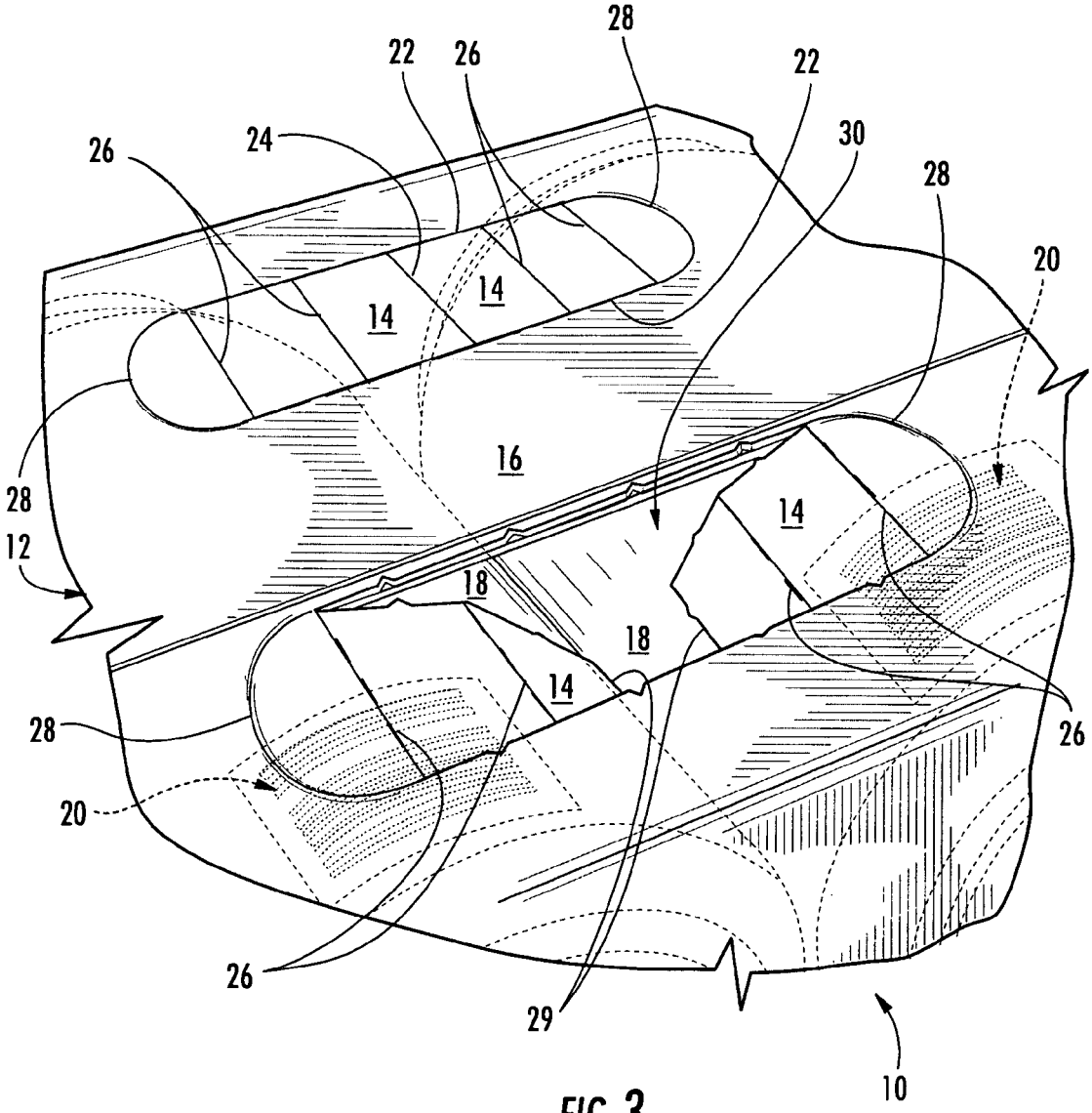
FIG. 3 is like FIG. 2, except that one pair of the handle flaps is in an open configuration.

FIGS. 2 and 3 are also schematic because, for example, broken lines are used to illustrate articles, namely twelve ounce cans 18, that are contained in the carton 10, would otherwise be substantially hidden from view within the carton 10, and include pricing bar codes 20, or the like. The carton 10 is for snugly containing twenty-four cans arranged in four coplanar rows of six, although other overall sizes and shapes of cartons are also within the scope of the present invention. Articles other than cylindrical twelve-ounce cans 18 are also within the scope of the present invention.

The pricing bar codes 20, or the like, are optional features that may or may not be present. Nonetheless, and in accordance with the first embodiment of the present invention, the handle flaps 14 can advantageously obstruct pricing bar codes 20 on the cans 18 from view, even when the handle flaps are "open", as will be discussed in greater detail below. Blocking the can's bar codes 20 from view advantageously helps to ensure that the carton's pricing bar code (not shown), rather than one of the bar codes 20 on the cans 18, is optically scanned when the carton 10 contains cans 18 and is sold at a retail outlet, or the like.

The two handle flaps 14 that are on one side of the composite handle 16 can be collectively referred to as a pair of the handle flaps 14, and the two handle flaps 14 that are on the other side of the composite handle 16 can be collectively referred to as another pair of the handle flaps 14. In FIGS. 1 and 2, the handle flaps 14 are in their closed configurations.

As best understood with reference to FIG. 2, each pair of the handle flaps 14 includes laterally spaced apart, typically straight, longitudinal tear lines 22, as well as a lateral tear line 24 that typically extends between the middle points of the longitudinal tear lines. For each pair of the handle flaps 14, the lateral tear line 24 defines an edge of the handle flaps, with these edges of the handle flaps initially being adjacent to one another. As will be discussed in greater detail below, each of the tear lines 22, 24 can alternatively be a continuous slit, or the like.

In accordance with the first exemplary embodiment, each of the handle flaps 14 includes two lateral fold lines 26, one of which is at the end of the handle flap, and the other of which bisects the handle flap. The fold lines 26 at the ends of the handle flaps 14 can be characterized as respectively being, or respectively marking, the pivotable connections between the handle flaps 14 and the composite top panel 12. Other pivotable connections are also within the scope of the present invention. In addition, an arcuate score line 28 is adjacent the outer end of each of the handle flaps 14. The opposite ends of each score line 28 are respectively contiguous with the ends of the associated longitudinal tear lines 22.

In accordance with the first embodiment of the present invention, the score lines 28 help to provide a visual cue to a user to help the user understand that the handle flaps 14 can be engaged in the process of picking up the carton 10 by the composite handle 16. That is, the flaps 14 in combination with the score lines 28 help to at least generally provide the appearance of what is sometimes referred to as a "racetrack handle". In addition, and in theory to which the present invention is not intended to be limited, the score lines 28 can also help with dissipating, or controlling the distribution of, stress that may result in the composite top panel 12 in response to manual manipulation of the flaps 14 and/or a user carrying the carton by the composite handle 16, as will be discussed in greater detail below. Nonetheless, in one version of the first embodiment, the score lines 28 can be omitted.

The cans 18 within the carton 10 are at least generally cylindrical, with the axes of the cylinders being parallel to the lateral tear lines 24 and lateral fold lines 26, and perpendicular to the longitudinal tear lines 22. Each of the pairs of handle flaps 14 is typically centered with respect to a pair of adjacent cans 18 that are adjacent the handle flaps. As a result, in a top plan view of the carton 10, the lateral tear lines 24 are typically centered between the pair of adjacent cans 18 that are adjacent the handle flaps 14.

As best understood with reference to FIG. 3, for each pair of handle flaps 14, the tear lines 22, 24 can be torn by manually pressing the central portion of the pair of handle flaps 14 inwardly, to separate the handle flaps 14 from the composite top panel 12, except that each of the handle flaps will continue to be connected to the composite top panel by the respective fold line 26 that functions as the pivotable connection of the handle flap to the top panel. While the pair of handle flaps 14 is pressed inwardly, the flaps' edges 29 that were originally defined by the tear line 24 pivot into the interior of the carton 10 and away from one another. Whereas only one of the pairs of handle flaps 14 is in its open configuration in FIG. 3, the other pair of the handle flaps can be placed in an at least substantially similar open configuration.

In accordance with the first embodiment of the present invention, each pair of the handle flaps 14 at least partially occludes, and more specifically substantially completely occludes, a respective handle opening 30 (FIG. 3) while the handle flaps are in their closed configuration illustrated in FIG. 2. In contrast, the handle flaps 14 are opened to expose, or further expose, the respective handle opening 30, as shown for one of the pairs of handle flaps in FIG. 3. The handle opening 30 is exposed for receiving the fingers of a user so that the fingers can pass beneath the composite handle 16 for the purpose of lifting the carton 10. With regard to the pair of the handle flaps 14 that is illustrated in the open configuration in FIG. 3, the lateral fold lines 26 can enhance the manner in which the edges 29, which were originally defined by the tear line 24, pivot into the interior of the carton 10 and away from one another. More specifically, the lateral fold lines 26 can allow the open handle flaps 14 to readily engage and bend partially around, and therefore at least partially conform to, the shape of the adjacent cans 18 in the carton 10. With the handle flaps 14 at least partially conforming to the shape of the cans 18, pricing bar codes 20 on the cans can be at least somewhat covered and blocked from view, and more specifically substantially blocked from view, with the view being taken from outside of the carton 10 through the open handle opening 30. In accordance with the first embodiment of the present invention, the pricing bar codes 20 are blocked from view while all of the handle flaps 14 are in their open configuration (e.g., see the open handle flaps associated with the handle opening 30 in FIG. 3) irrespective of the rotational position of the cans about their axes. This advantageously at least discourages the pricing bar codes 20 on the cans 18 within the carton 10 from being scanned by an optical scanner being used for checking out at a retail outlet, such as a grocery store.

In accordance with an alternative embodiment of the present invention, additional lateral fold lines 26 can be provided to enhance the manner in which the handle flaps 14 conform to the cans 18. Alternatively, the lateral fold line 26 can be omitted, although they may be replaced with creases in response to a user using the handle flaps 14. The cans 18 can be replaced with other articles that are not necessarily cylindrical, in accordance with an alternative embodiment of the present invention.

Figure 4:
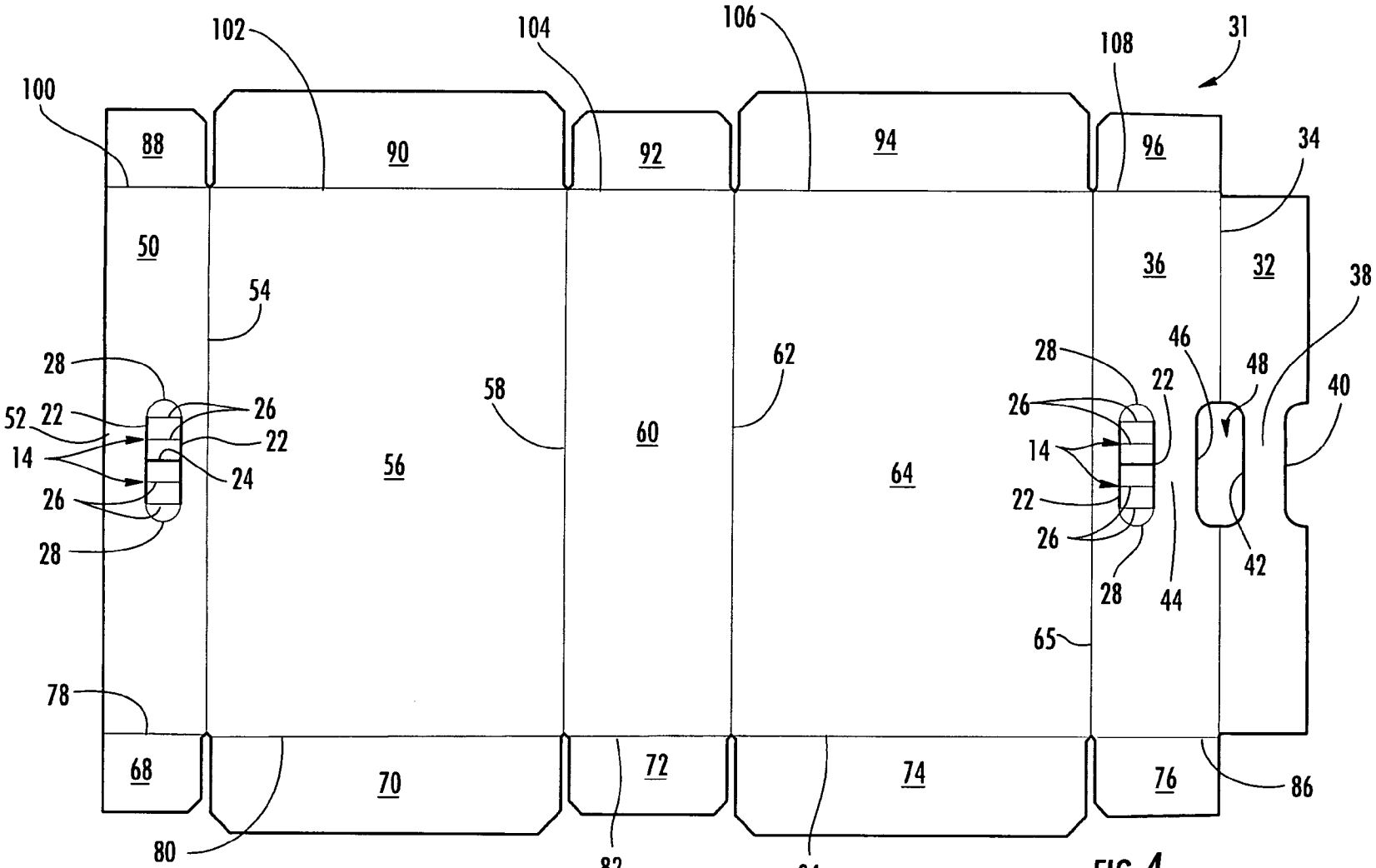
FIG. 4 is a schematic plan view of a blank from which the carton of FIG. 1 can be erected.

FIG. 4 schematically illustrates a blank 31 from which the carton 10 can be acceptably erected. The composite top panel 12 (FIG. 1) includes an inner top panel 32 (e.g., reinforcing panel) connected along a longitudinal fold line 34 to a middle top panel 36. The inner top panel 32 includes an inner handle layer 38 (i.e., a portion of the composite handle 16). The inner handle layer 38 is defined between cut edges 40, 42. The middle top panel 36 includes a middle handle layer 44 (i.e., a portion of the composite handle 16). The middle handle layer 44 is defined between a cut edge 46 and the adjacent longitudinal fold line 22 of the handle flaps 14 of the middle top panel 36. Curved ends of the cut edges 42, 46 are connected to define an opening 48 that extends through the blank 31. The cut edge 40 can also be characterized as defining an opening that extends through the blank.

The composite top panel 12 further includes an outer top panel 50. The outer top panel 50 includes an outer handle layer 52 (i.e., a portion of the composite handle 16) defined between an outer edge of the outer top panel and the adjacent longitudinal fold line 22 of the handle flaps 14 of the outer top panel 50. The outer top panel 50 is connected to a rear panel 56 at a longitudinal fold line 54. The rear panel 56 is connected to a bottom panel 60 along a longitudinal fold line 58. The bottom panel 60 is connected along a longitudinal fold line 62 to a front panel 64. The front panel 64 is connected to the middle top panel 36 along a longitudinal fold line 65.

The carton 10 includes a composite left end panel 66 (FIG. 1) that includes left end panels 68, 70, 72, 74, 76. The left end panels 68, 70, 72, 74, 76 are respectively connected to the outer top panel 50, rear panel 56, bottom panel 60, front panel 64, and middle top panel 36 along lateral fold lines 78, 80, 82, 84, 86.

The carton 10 further includes a composite right end panel (schematically illustrated by broken lines in FIG. 1) that includes right end panels 88, 90, 92, 94, 96. The right end panels 88, 90, 92, 94, 96 are respectively connected to the outer top panel 50, rear panel 56, bottom panel 60, front panel 64, and middle top panel 36 along lateral fold lines 100, 102, 104, 106, 108.

Erection of the carton 10 from the blank 31 can begin by folding the inner top panel 32 180° about the longitudinal fold line 34, so that surfaces of the inner top panel and the middle top panel 36 are in opposing face-to-face configuration with respect to one another. Typically, adhesive material is previously applied to at least one of the surfaces of the inner top panel 32 and the middle top panel 36 that are in opposing face-to-face configuration with respect to one another, so that the inner top panel is securely fastened to the middle top panel. Throughout this Detailed Description section of this disclosure, the adhesive material referred to can be glue or any other adhesive material typically used in the erection of cartons, or the like.

Thereafter, folding takes place along the longitudinal fold lines 54, 58, 62, 65 so that the inner top panel 32 is in the interior of the carton 10 and the outer top panel 50 is overlapping a portion of the middle top panel 36 as illustrated in FIG. 1. As a result, surfaces of the outer top panel 50 and the middle top panel 36 are in opposing face-to-face configuration with respect to one another. Typically, adhesive material is previously applied to at least one of the surfaces of the outer top panel 50 and the middle top panel 36 that are in opposing face-to-face configuration with respect to one another, so that the outer top panel and the middle top panel are securely fastened together.

The carton 10 is erected from the blank 31 so that the handle layers 38, 44, 52 are respectively aligned one on top of the other so that they together define the composite handle 16. Accordingly and in accordance with the first embodiment, the composite handle 16 is a multi-ply handle, and more specifically it is a three-ply handle, although it can include more or less plies. In addition, the cut edge 40 is adjacent the respective longitudinal tear line 22 of the pair of handle flaps 14 in the middle top panel 36. Similarly, the cut edges 42, 46 are adjacent the respective longitudinal tear line 22 of the pair of handle flaps 14 in the outer top panel 50. The inner top panel 32 and its inner handle layer 38 advantageously reinforce the carton 10.

The composite left end panel can be formed by folding the left end panels 68, 70, 72, 74, 76 inwardly so that they respectively are overlapping with respect to one another and are fastened with adhesive material. Similarly, the composite right end panel can be formed by pivoting the right end panels 88, 90, 92, 94, 96 inwardly so that they respectively are overlapping with respect to one another and fastened together with adhesive material.

The inner top panel 32 can be considered optional; therefore, it can be omitted. As one example, the composite top panel 12 (FIG. 1-3) can be replaced with a single top panel that includes both pairs of the handle flaps 14 on opposite sides of a single layer handle. Alternatively, the carton 10 can include only one of the pairs of handle flaps 14.

In accordance with the first embodiment of the present invention, a fold line can be any at least somewhat line-like arranged, although not necessarily straight, form of weakening that facilitates folding therealong; and a tear line can be any at least somewhat line-like arranged, although not necessarily straight, form of weakening that facilitates tearing therealong. More specifically, but not for the purpose of narrowing the scope of the present invention, conventional fold lines include: a crease, such as formed by folding; a score line, such as formed with a blunt scoring knife, or the like, which creates a crushed portion in the material along the desired line of weakness; a slit that extends partially into the material along the desired line of weakness, and/or a series of spaced apart slits that extend partially into and/or completely through the material along the desired line of weakness; or various combinations of these features. More specifically, but not for the purpose of narrowing the scope of the present invention, conventional tear lines include: a slit that extends partially into the material along the desired line of weakness, and/or a series of spaced apart slits that extend partially into and/or completely through the material along the desired line of weakness, or various combinations of these features.

As a more specific example, one type of conventional tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line.

In situations where cutting is used to provide a fold line, typically the cutting will not be overly extensive in a manner that might cause a reasonable user to incorrectly consider the fold line to be a tear line. In contrast, where nicks are present in a tear line, typically the nicks will not be overly large or overly numerous in a manner that might cause a reasonable user to incorrectly consider the subject line to be a fold line.

Figure 5:
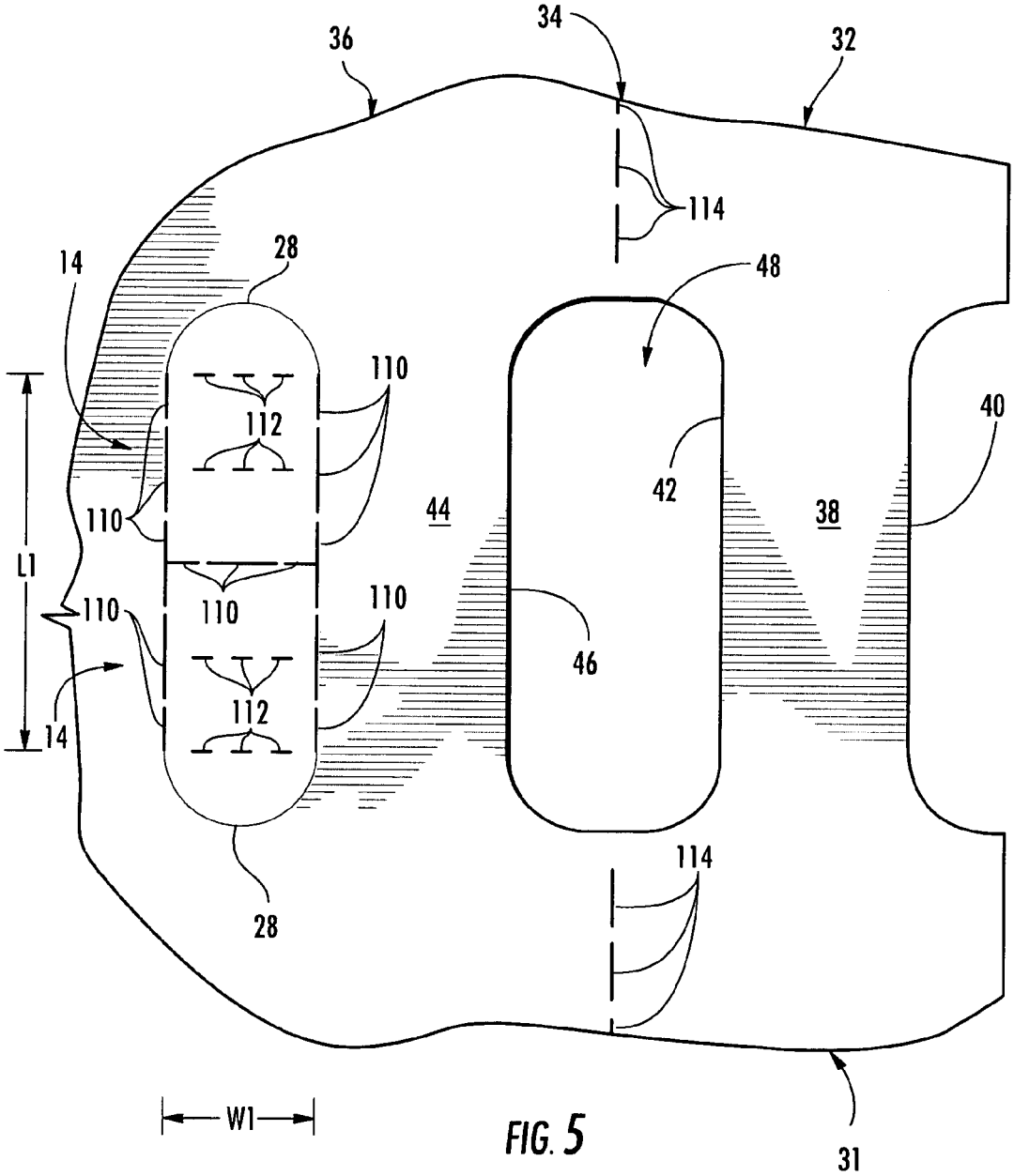
FIG. 5 is a plan view of a portion of the blank of FIG. 4.

FIG. 5 illustrates a portion of the blank 31, namely a pair of the handle flaps 14 in greater detail. The pair of handle flaps 14 illustrated in FIG. 5 is representative of both of the pairs of handle of the first embodiment of the present invention. In accordance with one specific version of the first embodiment of the present invention, and as best understood with by contrasting FIGS. 2, 4 and 5, each of the tear lines 22, 24 is in the form of a series of spaced apart slits 110 that extend completely through the blank 31, with adjacent slits 110 of the same tear line being spaced apart slightly so that a nick is defined between the adjacent slits. Also in accordance with this specific version, all of the fold lines are score lines, except that: the handle flap's fold lines 26 (FIGS. 2-4) are each in the form of fold lines formed by a series of spaced apart slits 112 (FIG. 5) that extend completely through the blank 31, the fold line 34 (FIGS. 4 and 5) between the inner and middle top panels 32, 36 is in the form of fold lines formed by a series of spaced apart slits 114 (FIG. 5) that extend completely through the blank 31, and the lateral fold lines 78, 80, 82, 84, 86, 100, 102, 104, 106, 108 are each in the form of a series of spaced apart slits that are formed in and along a score line, with these slits extending completely through the blank.

Further referring to FIG. 5, the illustrated pair of handle flaps 14 has an overall length L1 that extends in the longitudinal direction, and a width W1 that extends in the lateral direction. In accordance with the first embodiment of the present invention, the overall length L1 is greater than the width W1; and in the carton 10 formed from the blank 31, the cylindrical axes of the cans 18 (FIGS. 2 and 3) extend in the lateral direction. More specifically, the overall length L1 is at least about twice as large as the width W1. Even more specifically, the length L1 can be about 2.5 inches, and the width W1 can be about 1.0 inch.

Any of the known dispensing features that are suitable for use in the carton 10 may be incorporated into the carton for allowing a user to readily remove one or more of the cans 18 from the carton. Alternatively, a user can access the cans 18 by separating portions of the end panels from one another in the composite left end panel 66 or the composite right end panel.

A carton 210 (FIGS. 6 and 7) and blank 231 (FIGS. 8 and 9) of a second embodiment of the present invention are respectively like the carton 10 and blank 31 of the first embodiment of the present invention, except for variations noted and variations that will be apparent to those of ordinary skill in the art in view of this disclosure. Accordingly, the same reference numerals are respectively used to identify identical features of the first and second embodiments. Reference numerals are incremented by 200 for features of the second embodiment that are generally similar to, yet in some ways different from, corresponding features of the first embodiment.

Figure 6:
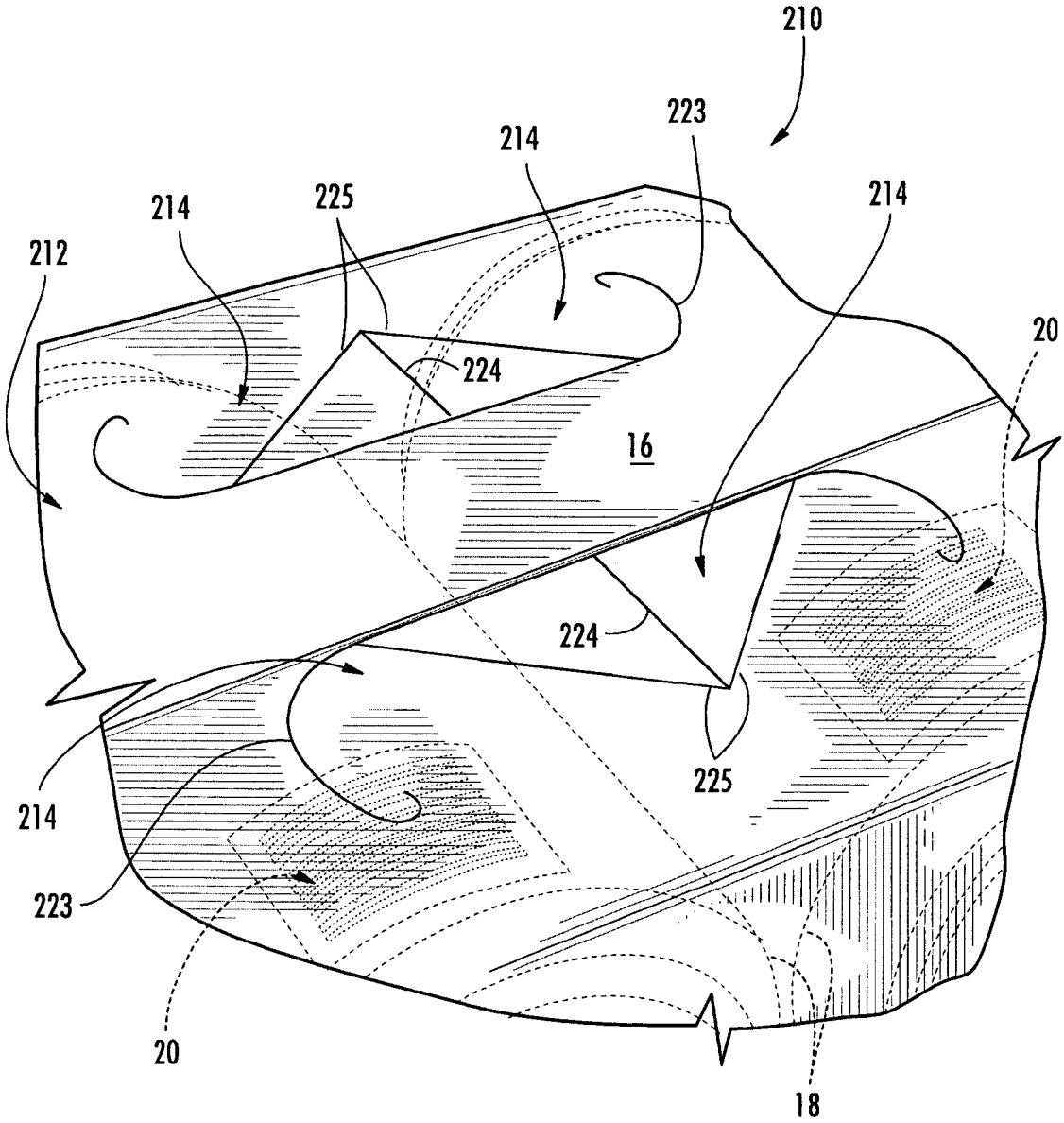
FIG. 6 is a schematic pictorial view of a portion of a carton with handle flaps in their closed configuration, in accordance with a second embodiment of the present invention.
Figure 7:
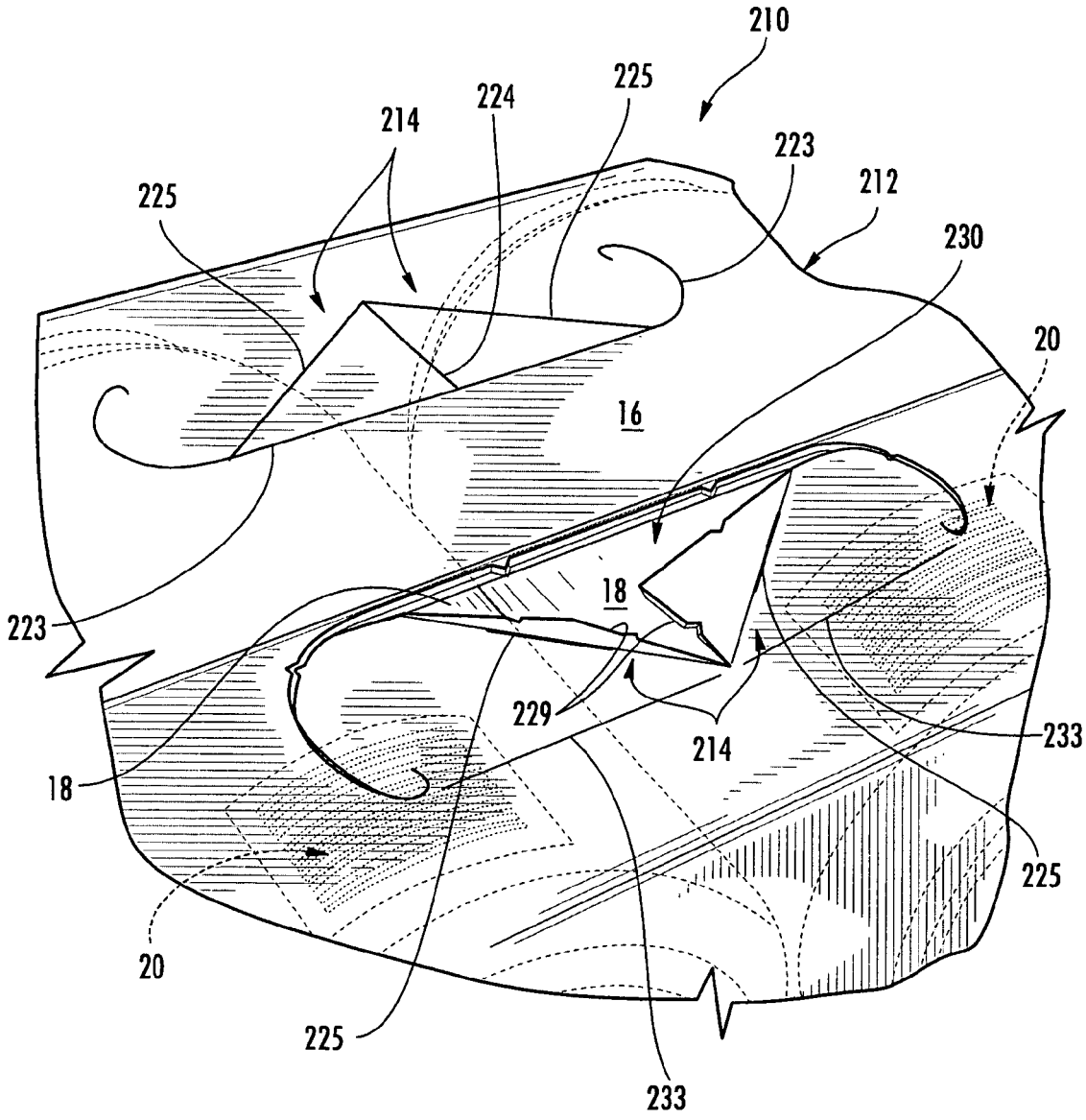
FIG. 7 is like FIG. 6, except that one of the pairs of handle flaps is in its open configuration.

FIGS. 6 and 7 are schematic because, for example, broken lines are used to illustrate the articles, namely cans 18, that would otherwise be substantially hidden from view within the carton 210 and include pricing bar codes 20, or the like. In accordance with the second embodiment of the present invention, each pair of handle flaps 214 is defined by a generally longitudinal, double-hooked tear line 223 and a lateral tear line 224, as well as oblique fold lines 225. For each of the double-hooked tear lines 223, its middle is typically straight and extends in the longitudinal direction, but its opposite ends curve toward the lateral direction and terminate in hook-like shapes. The hook-shaped ends of the double-hooked tear lines 223 seek to prevent tearing beyond the ends of the double-hooked tear lines. Differently shaped ends of the double-hooked tear lines 223 are also within the scope of the present invention. In particular, different shapes and/or structures at the end of the double-hooked tear lines 223 can be employed to inhibit tearing beyond their ends.

As best understood with reference to FIG. 7, for each pair of handle flaps 214, the tear lines 223, 224 can be torn to partially separate the handle flaps 214 from the composite top panel 212. While the central portion of the pair of handle flaps 14 is pressed inwardly, the edges 229 that were originally defined by the tear line 224 pivot into the interior of the carton 10. Whereas only one of the pairs of handle flaps 214 is in its open configuration and thereby providing a handle opening 230 in FIG. 7, the other pair of the handle flaps can be placed in an at least substantially similar open configuration.

The cans 18 within the carton 210 are at least generally cylindrical, with the axes of the cylinders being parallel to the lateral tear lines 224, perpendicular to the middle of the double-hooked tear lines 223, and oblique to the oblique fold lines 225. Each of the pairs of handle flaps 214 is typically centered with respect to a pair of adjacent cans 18 that are adjacent the handle flaps. As a result, in a top plan view of the carton 210, the lateral tear lines 224 are typically centered between the pair of adjacent cans 18 that are adjacent the handle flaps.

While a pair of the handle flaps 214 is in its open configuration as illustrated in FIG. 7, the oblique fold lines 225 allow the open handle flaps to further engage and at least somewhat bend around, and therefore at least partially conform to the shape of, the adjacent cans 18 in the carton 210. With regard to the pair of the handle flaps 214 that is illustrated in the open configuration in FIG. 7, the oblique fold lines 225 can enhance the manner in which the edges 229, which were originally defined by the tear line 224, pivot into the interior of the carton 210 and away from one another. More specifically, the oblique fold lines 225 can allow the open handle flaps 214 to readily engage and bend partially around, and therefore at least partially conform to, the shape of the adjacent cans 18 in the carton 210.

With the handle flaps 214 at least partially conforming to the shape of the cans 18, pricing bar codes 20 on the cans can be at least somewhat blocked from view, in a manner similar to that discussed above.

Depending upon how much force a user puts on a pair of the handle flaps 214 and the amount of space that is available for pivoting of the flaps, crease(s) 233 (FIG. 7) can form. The crease(s) 233 can run from proximate one of the ends of the double-hooked tear line 223 to the other of the ends of the double-hooked tear line, and proximate the ends of the edges 229. As a result, the crease(s) 233 can mark the boundary at one side of a pair of the opened handle flaps 214. The respective portions of the crease(s) 233 can be characterized as respectively being, or respectively marking, the pivotable connections between the handle flaps 214 and the composite top panel 212. Other pivotable connections are also within the scope of the present invention. For example and in accordance with an alternative embodiment of the present invention, the crease(s) 233 are replaced with score line(s) that are present for each pair of the handle flaps 214 in the blank 231 and carton 210 before the handle flaps 214 are opened.

Figure 8:
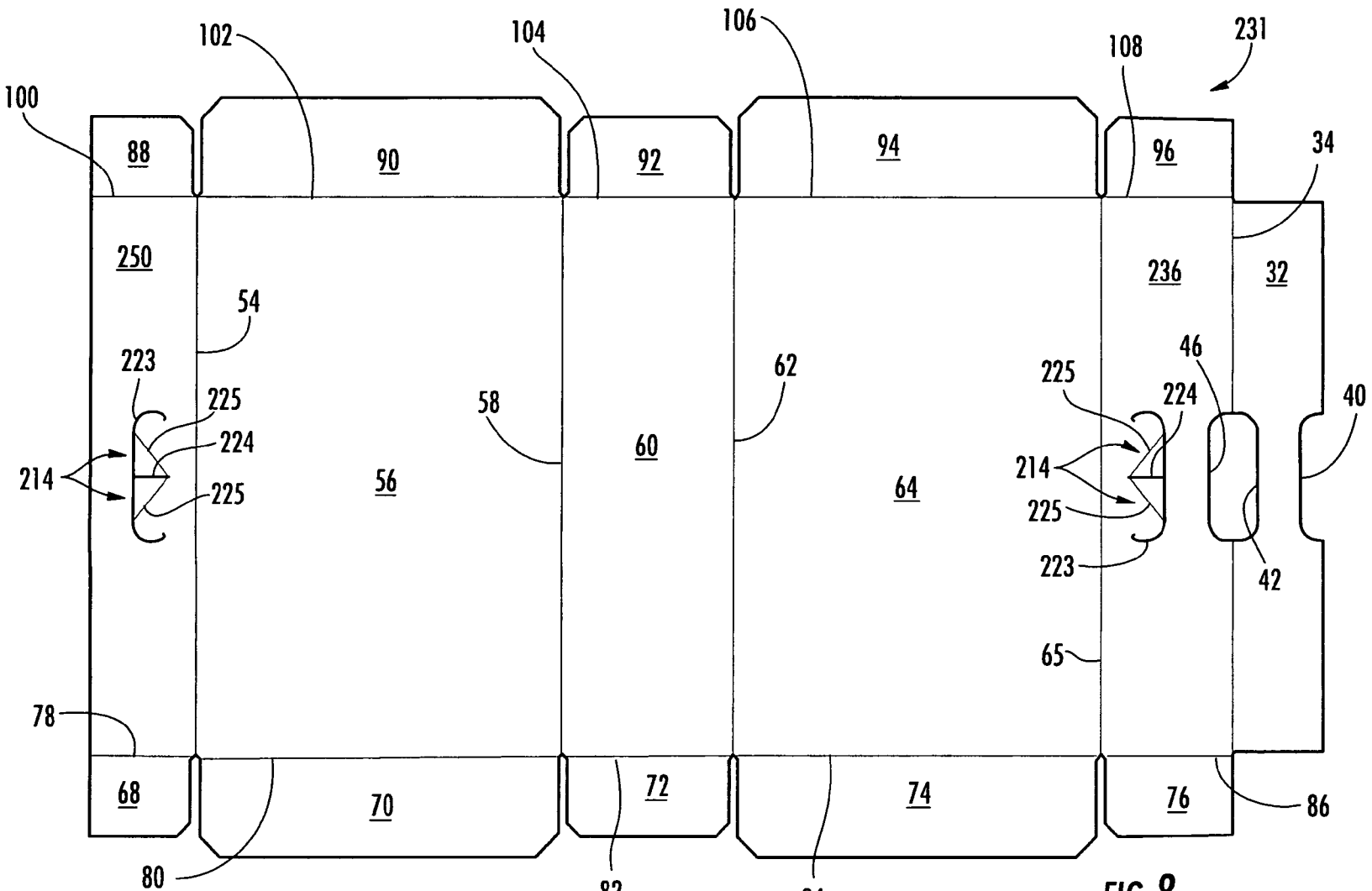
FIG. 8 is a schematic plan view of a blank from which the carton of the second embodiment can be erected.
Figure 9:
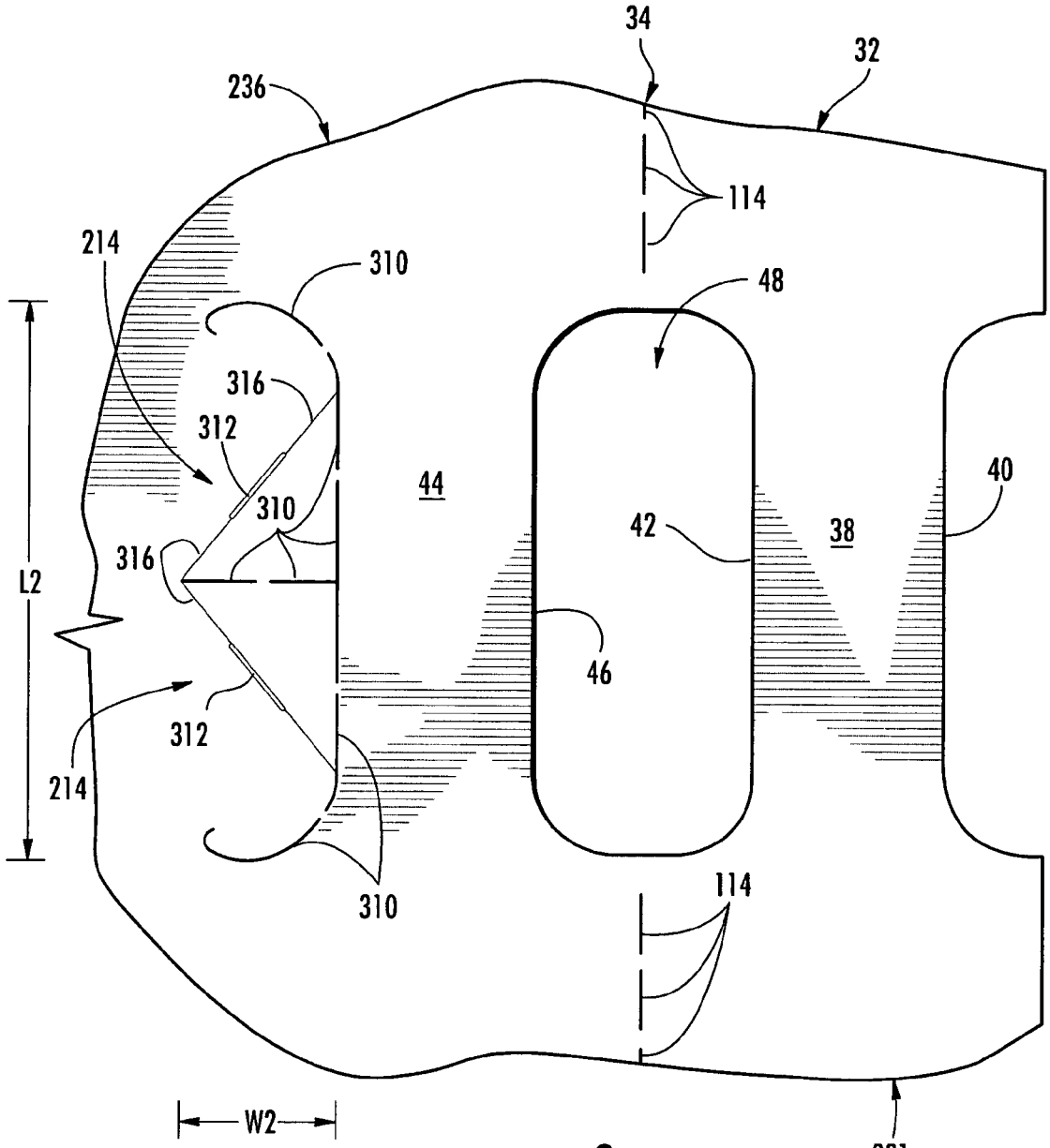
FIG. 9 is a schematic plan view of a portion of the blank of FIG. 8.

FIG. 8 schematically illustrates a blank 231 from which the carton 210 can be erected. FIG. 9 illustrates a pair of the handle flaps 214 of the blank 231 in greater detail. The pair of handle flaps 214 illustrated in FIG. 9 is representative of both of the pairs of handle flaps illustrated in FIG. 8, except that the two pairs of handle flaps are oriented in opposite directions with respect to one another in FIG. 8. In accordance with one specific version of the second embodiment of the present invention, and as best understood by contrasting FIGS. 8 and 9, each of the double-hooked tear lines 223 and lateral tear lines 224 is in the form of a series of spaced apart slits 310 that extend completely through the blank 231, with adjacent slits 310 of the same tear line being spaced apart slightly so that a nick is defined between the adjacent slits 310. Also in accordance with this specific version, all of the fold lines are score lines, except that: the fold lines 225 (FIGS. 6-8) are each in the form of a slit 312 (FIG. 9) that is formed in and along a score line 316 (FIG. 9) that extends all the way from an end of the associated lateral tear line 224 to the respective end of the straight section of the associated double-hooked tear line 223, with the slits 312 extending completely through the blank 231; the fold line 34 (FIGS. 8 and 9) between the inner and middle top panels 236, 32 is in the form of fold line formed by a series of spaced apart slits 114 (FIG. 9) that extend completely through the blank 231; and the lateral fold lines 78, 80, 82, 84, 86, 100, 102, 104, 106, 108 are each in the form of a series of spaced apart slits that are formed in and along a score line, with these slits extending completely through the blank.

Further referring to FIG. 9, the illustrated pair of handle flaps 214 has an overall length L2 that extends in the longitudinal direction, and a width W2 that extends in the lateral direction. In accordance with the second embodiment of the present invention, the overall length L2 is greater than the width W2; and in the carton 210 formed from the blank 231, the cylindrical axes of the cans 18 (FIGS. 6 and 7) extend in the lateral direction. More specifically, the overall length L2 is at least about twice as large as the width W2. Even more specifically, the length L2 can be about 3.5 inches, and the width W2 can be about 1.0 inch.

In accordance with the first and second embodiments of the present invention, the blanks 32, 232 are constructed of paperboard, or the like, and the paperboard can optionally have one or more other materials coated or laminated thereon. For example, paperboard typically weighs at least about 100 pounds per ream, with each sheet of paperboard typically being at least about 0.012 inches thick, so that it is heavier and more rigid than ordinary paper. The blanks can also be constructed of other materials, such as cardboard, or any other material having properties suitable for enabling the cartons 10, 210 to function at least generally as described above.

For example, one or both sides of the blanks 32, 232 can be coated with a clay coating, or the like. The clay coating can be printed over with product, advertising, and other information or images. The blanks may then be coated with a varnish or other protective coating to protect any information printed on the blank. The blanks may also be coated with, for example, a moisture barrier layer, on either or both sides of the blanks. Other coating and laminating upon the blanks is also within the scope of the present invention.

The directional references, for example "top", "front", "left end" and "longitudinal", referred to in this Detailed Description section are used for ease of understanding rather than for the purpose of narrowing the scope of the present invention. For example and alternatively, the top panel can be referred to as a bottom, side or end panel, and the other directional references can also be modified and/or exchanged.

The pricing bar codes 20 (FIGS. 2, 3, 6 and 7) can be very generally characterized as encoded information that is for being optically scanned. The pricing bar codes 20 can be replaced with any other types of encoded information that is for being optically scanned, such as the symbologies of U.S. Pat. No. 4,998,010 or other symbologies. In addition, and very generally described, the bar codes 20 can be replaced with any indicia, whether encoded or not, that is for being optically scanned or otherwise seen.

It will be understood by those skilled in the art that while the present invention has been discussed above with reference to exemplary embodiments, various additions, modifications and changes can be made thereto without departing from the spirit and scope of the invention as set forth in the following claims.

What is claimed is:

1. A carrier in combination with articles, the carrier comprising:

at least one panel that partially defines an interior of the carrier, wherein the articles are in the interior; and at least first and second handle flaps that are for being at least initially adjacent to one another for together at least partially obstructing a handle opening in the panel, with the first and second handle flaps being operative for allowing the first and second handle flaps to be pivoted at least partially into the interior of the carrier so that the handle opening in the panel is at least further exposed, the first handle flap at least partially covers a first article of the articles so that the first handle flap at least partially blocks the first article from view, and the second handle flap at least partially covers a second article of the articles so that the second handle flap at least partially blocks the second article from view, wherein the first and second articles are adjacent to one another, are within the interior of the carton, and are proximate the handle opening, the first article includes encoded pricing information, and the first article is arranged and the first handle flap is adapted so that the first handle flap is for substantially blocking the encoded pricing information from view when the first handle flap is pivoted substantially into the interior of the carrier so that the handle opening is substantially exposed.

2. The combination according to claim 1, wherein the panel is a top panel, and the carrier further comprises:

opposite end panels respectively connected to a first pair of opposite edges of the top panel, opposite front and rear panels respectively connected to a second pair of opposite edges of the top panel, and a bottom panel having edges respectively connected to the end, front and rear panels.

3. The combination according to claim 1, wherein:

there are first and second pivotable connections respectively between the first and second handle flaps and the panel, and the first and second pivotable connections are operative for respectively allowing the first and second handle flaps to be pivoted at least partially into the interior of the carrier to at least further expose the handle opening in the panel; and for each handle flap of the first and second handle flaps, the handle flap includes at least one fold line positioned between an edge of the handle flap and the pivotable connection between the handle flap and the panel, with the fold line being operative for allowing a first portion of the handle flap to be pivoted relative to a second portion of the handle flap and farther into the interior of the carton than the second portion of the handle flap, so that the edges of the first and second handle flaps can be at least partially pivoted away from one another.

4. The combination according to claim 3, wherein:

the fold line of the first handle flap is distant from, and extends at least about parallel to, the pivotable connection between the first handle flap and the panel; and the fold line of the second handle flap is distant from, and extends at least about parallel to, the pivotable connection between the second handle flap and the panel.

5. The combination according to claim 3, wherein:

the fold line of the first handle flap extends obliquely with respect to the edge of the first handle flap; and the fold line of the second handle flap extends obliquely with respect to the edge of the second handle flap.

6. The combination according to claim 5, wherein:

an end of the fold line of the first handle flap is contiguous with the edge of the first handle flap; and an end of the fold line of the second handle flap is contiguous with the edge of the second handle flap.

7. The combination according to claim 3, wherein the edges of the first and second handle flaps are at least initially adjacent to one another.

8. The combination according to claim 7, further comprising at least one nick connecting the edge of the first handle flap to the edge of the second handle flap.

9. The combination according to claim 3, wherein:

the handle opening is a first handle opening;

the carrier further comprises third and fourth handle flaps that are for being at least initially adjacent to one another, with there being third and fourth pivotable connections respectively between the third and fourth handle flaps and the panel;

the third and fourth pivotable connections are operative for respectively allowing the third and fourth handle flaps to be pivoted at least partially into the interior of the carrier to at least further expose a second handle opening in the panel;

the first and second articles are also proximate the second handle opening;

for each handle flap of the third and fourth handle flaps, the handle flap includes at least one fold line positioned between an edge of the handle flap and the pivotable connection between the handle flap and the panel, with the fold line being operative for allowing a first portion of the handle flap to be pivoted relative to a second portion of the handle flap and farther into the interior of the carton than the second portion of the handle flap, so that the edges of the third and fourth handle flaps can be at least partially pivoted away from one another, the third handle flap can at least partially cover, engage and bend partially around the first article, whereby the third handle flap at least partially blocks the first article from view, and the fourth handle flap can at least partially cover, engage and bend partially around a second article, whereby the fourth handle flap at least partially blocks the second article from view;

the first and second handle openings are spaced apart from one another;

the carrier further comprises a multi-ply handle positioned between the first and second handle openings; and each of the first, second, third and fourth handle flaps is adjacent the multi-ply handle.

10. The combination according to claim 1, wherein:

the encoded pricing information is adjacent the handle opening;

the first handle flap is pivoted substantially into the interior of the carrier so that the handle opening is substantially exposed; and the first handle flap is substantially blocking the encoded pricing information from view while the first handle flap is pivoted substantially into the interior of the carrier so that the handle opening is substantially exposed.

11. The combination according to claim 10, wherein the first handle flap at least partially covers, engages and bends partially around the first article.

12. The combination according to claim 11, wherein the first handle flap is engaged to and bent partially around the first article.

13. The combination according to claim 1, wherein the panel comprises a handle, each of the first and second handle flaps is adjacent the handle, and the handle is a multi-ply handle.

14. A carrier that is for carrying articles and at least partially blocking the articles from view, the carrier comprising:

at least one panel that partially defines an interior of the carrier, wherein the interior is for receiving the articles;

first and second handle flaps that are for being at least initially adjacent to one another for together at least partially obstructing a first handle opening in the panel, with there being first and second pivotable connections respectively between the first and second handle flaps and the panel, and the first and second pivotable connections being operative for respectively allowing the first and second handle flaps to be pivoted at least partially into the interior of the carrier to at least further expose the first handle opening in the panel;

third and fourth handle flaps that are for being at least initially adjacent to one another for together at least partially obstructing a second handle opening in the panel, with there being third and fourth pivotable connections respectively between the third and fourth handle flaps and the panel, and the third and fourth pivotable connections being operative for respectively allowing the third and fourth handle flaps to be pivoted at least partially into the interior of the carrier to at least further expose the second handle opening in the panel; and a handle positioned between the first and second handle openings, wherein each of the first, second, third and fourth handle flaps is adjacent the handles, the first handle opening includes opposite first and second ends, the first handle opening includes opposite first and second sides, the first and second sides extend from the first end to the second end, the first handle opening has a length that extends from the first end to the second end, the first handle opening has a width that extends from the first side to the second side, the length is greater than the width, the first pivotable connection, which is between the first handle flap and the panel, comprises a first fold line that is located at, and extends along, the first end of the handle opening, and the second pivotable connection, which is between the second handle flap and the panel, comprises a second fold line that is located at, and extends along, the second end of the handle opening.

15. The carrier according to claim 14, wherein the carrier is a parallelepiped-shaped carton.

16. The carrier according to claim 14, wherein the panel comprises first and second panels that are at least partially overlapping with respect to one another, and the handle is a multi-ply handle.

17. The carrier according to claim 14 in combination with the articles, wherein the articles are in the interior of the carrier.

18. The carrier according to claim 14, wherein the panel is a top panel and the carrier further comprises:

a front panel that is connected to the top panel at a front fold line, wherein the front panel extends downwardly from the front fold line, a rear panel that is connected to the top panel at a rear fold line, wherein the rear panel extends downwardly from the rear fold line, a right end panel that is connected to the top panel at a right fold line, wherein the right end panel extends downwardly from the right fold line, and a left end panel that is connected to the top panel at a left fold line, wherein the left end panel extends downwardly from the left fold line, wherein each of the first and second fold lines is not collinear with any of the front, rear, right and left fold lines.

19. A carrier that is for carrying articles and at least partially blocking the articles from view, the carrier comprising:

at least one panel that partially defines an interior of the carrier, wherein the interior is for receiving the articles;

first and second handle flaps that are for being at least initially adjacent to one another for together at least partially obstructing a first handle opening in the panel, with there being first and second pivotable connections respectively between the first and second handle flaps and the panel, and the first and second pivotable connections being operative for respectively allowing the first and second handle flaps to be pivoted at least partially into the interior of the carrier to at least further expose the first handle opening in the panel;

third and fourth handle flaps that are for being at least initially adjacent to one another for together at least partially obstructing a second handle opening in the panel, with there being third and fourth pivotable connections respectively between the third and fourth handle flaps and the panel, and the third and fourth pivotable connections being operative for respectively allowing the third and fourth handle flaps to be pivoted at least partially into the interior of the carrier to at least further expose the second handle opening in the panel; and a handle positioned between the first and second handle openings, wherein each of the first, second, third and fourth handle flaps is adjacent the handle, wherein for at least each handle flap of the first and second handle flaps, the handle flap includes at least one fold line positioned between an edge of the handle flap and the pivotable connection between the handle flap and the panel, with the fold line being operative for allowing a first portion of the handle flap to be pivoted relative to a second portion of the handle flap and farther into the interior of the carton than the second portion of the handle flap, so that the edges of the first and second handle flaps can be at least partially pivoted away from one another, and the edges of the first and second handle flaps are at least initially adjacent to one another.

20. The carrier according to claim 19, wherein:

the fold line of the first handle flap is distant from, and extends at least about parallel to, the pivotable connection between the first handle flap and the panel; and the fold line of the second handle flap is distant from, and extends at least about parallel to, the pivotable connection between the second handle flap and the panel.

21. The carrier according to claim 19, wherein:

the fold line of the first handle flap extends obliquely with respect to the edge of the first handle flap; and the fold line of the second handle flap extends obliquely with respect to the edge of the second handle flap.

22. The carrier according to claim 21, wherein:

an end of the fold line of the first handle flap is contiguous with the edge of the first handle flap; and an end of the fold line of the second handle flap is contiguous with the edge of the second handle flap.

23. A carrier that is for carrying containers and at least partially blocking the containers from view, with the containers having walls respectively extending around the container's axes, the carrier comprising:

at least one panel that partially defines an interior of the carrier, wherein the interior is for receiving the containers so that the container's axes extend in a lateral direction; and at least a pair of handle flaps, with the pair of handle flaps including first and second handle flaps that each have an edge, wherein the edges of the first and second handle flaps are for being at least initially adjacent to one another for together at least partially obstructing a handle opening in the panel, and the first and second handle flaps are operative for allowing the first and second handle flaps to be pivoted at least partially into the interior of the carrier, so that the edges of the first and second handle flaps at least partially pivot away from one another to at least further expose the handle opening in the panel, wherein the pair of handle flaps extends in a longitudinal direction that is crosswise with respect to the lateral direction, the pair of handle flaps has a overall length that extends in the longitudinal direction, the edges of the first and second handle flaps extend at least generally in the lateral direction, the pair of handle flaps has a width that extends in the lateral direction, and the overall length is greater than the width, the panel comprises a handle, and each of the first and second handle flaps is adjacent the handle, the handle opening includes opposite first and second ends that each extend in the lateral direction, the handle opening includes opposite first and second sides that each extend in the longitudinal direction, the handle opening has a length that extends in the longitudinal direction, from the first end to the second end, the handle opening has a width that extends in the lateral direction, from the first side to the second side, the length of the handle opening is greater than the width of the handle opening, the first handle flap is connected to the panel by a first fold line that is located at, and extends along, the first end of the handle opening, and the second handle flap is connected to the panel by a second fold line that is located at, and extends along, the second end of the handle opening.

24. The carrier according to claim 23, further comprising at least one nick connecting the edge of the first handle flap to the edge of the second handle flap.

25. The carrier according to claim 23, wherein the overall length is at least about twice as large as the width.

26. The carrier according to claim 23, wherein:

the handle opening is a first handle opening;

the pair of handle flaps is a first pair of handle flaps;

the carrier further comprises a second pair of handle flaps, with the second pair of handle flaps including third and fourth handle flaps that each have an edge;

the edges of the third and fourth handle flaps are for being at least initially adjacent to one another for together at least partially obstructing a second handle opening in the panel;

the third and fourth handle flaps are operative for allowing the third and fourth handle flaps to be pivoted at least partially into the interior of the carrier, so that the edges of the third and fourth handle flaps at least partially pivot away from one another to at least further expose the second handle opening in the panel;

the second pair of handle flaps extends in the longitudinal direction and has a overall length that extends in the longitudinal direction;

the second pair of handle flaps has a width that extends in the lateral direction;

the overall length of the second pair of handle flaps is greater than the width of the second pair of handle flaps;

the first and second handle openings are spaced apart from one another;

the handle is positioned between the first and second handle openings; and each of the first, second, third and fourth handle flaps is adjacent the handle.

27. The carrier according to claim 23 in combination with the containers, wherein the containers are in the interior of the carrier, and the container's axes extend in the lateral direction.

28. The carrier according to claim 23, wherein the panel is a top panel and the carrier further comprises:

a front panel that is connected to the top panel at a front fold line, wherein the front panel extends downwardly from the front fold line, a rear panel that is connected to the top panel at a rear fold line, wherein the rear panel extends downwardly from the rear fold line, a right end panel that is connected to the top panel at a right fold line, wherein the right end panel extends downwardly from the right fold line, and a left end panel that is connected to the top panel at a left fold line, wherein the left end panel extends downwardly from the left fold line, wherein each of the first and second fold lines is not collinear with any of the front, rear, right and left fold lines.

29. A carrier that is for carrying containers and at least partially blocking the containers from view, with the containers having walls respectively extending around the container's axes, the carrier comprising:

at least one panel that partially defines an interior of the carrier, wherein the interior is for receiving the containers so that the container's axes extend in a lateral direction; and at least a pair of handle flaps, with the pair of handle flaps including first and second handle flaps that each have an edge, wherein the edges of the first and second handle flaps are for being at least initially adjacent to one another for together at least partially obstructing a handle opening in the panel, and the first and second handle flaps are operative for allowing the first and second handle flaps to be pivoted at least partially into the interior of the carrier, so that the edges of the first and second handle flaps at least partially pivot away from one another to at least further expose the handle opening in the panel, wherein the pair of handle flaps extends in a longitudinal direction that is crosswise with respect to the lateral direction, the pair of handle flaps has a overall length that extends in the longitudinal direction, the edges of the first and second handle flaps extend at least generally in the lateral direction, the pair of handle flaps has a width that extends in the lateral direction, and the overall length is greater than the width;

the panel comprises a handle, and each of the first and second handle flaps is adjacent the handle;

there are first and second pivotable connections respectively between the first and second handle flaps and the panel; and for each handle flap of the first and second handle flaps, the handle flap further includes at least one fold line positioned between the edge of the handle flap and the pivotable connection between the handle flap and the panel, with the fold line being operative for allowing a first portion of the handle flap to be pivoted relative to a second portion of the handle flap and farther into the interior of the carton than the second portion of the handle flap, so that the edges of the first and second handle flaps can be at least partially pivoted away from one another.

30. A blank for forming a carton, the blank comprising:

a first panel having first and second longitudinal edges that are laterally spaced apart from one another, wherein the first panel includes at least first and second handle flaps that each have an edge, the edges of the first and second handle flaps are adjacent to one another, the first and second handle flaps together at least partially obstruct a handle opening in the first panel, the handle opening includes opposite first and second ends, the handle opening includes opposite first and second sides, the first and second sides extend from the first end to the second end, the handle opening has a length that extends from the first end to the second end, the handle opening has a width that extends from the first side to the second side, the length is greater than the width, the first handle flap is connected to the first panel by a first fold line that is located at, and extends along, the first end of the handle opening, the second handle flap is connected to the first panel by a second fold line that is located at, and extends along, the second end of the handle opening, the first panel further includes a handle, and each of the first and second handle flaps is adjacent the handle;

a second panel having first and second longitudinal edges that are laterally spaced apart from one another, wherein the second longitudinal edge of the first panel is connected at a fold line to the first longitudinal edge of the second panel;

a third panel having first and second longitudinal edges that are laterally spaced apart from one another, wherein the second longitudinal edge of the second panel is connected at a fold line to the first longitudinal edge of the third panel; and a fourth panel having first and second longitudinal edges that are laterally spaced apart from one another, wherein the second longitudinal edge of the third panel is connected at a fold line to the first longitudinal edge of the fourth panel.

31. The blank according to claim 30, further comprising at least one nick connecting the edge of the first handle flap to the edge of the second handle flap.

32. The blank according to claim 30, wherein the first and second handle flaps are positioned between, and distant from, the first and second longitudinal edges of the first panel.

33. The blank according to claim 30, wherein:

for each handle flap of the first and second handle flaps, the handle flap includes at least one fold line;

the fold line of the first handle flap is distant from, and extends at least about parallel to, the edge of the first handle flap; and the fold line of the second handle flap is distant from, and extends at least about parallel to, the edge of the second handle flap.

34. The blank according to claim 30, wherein:

for each handle flap of the first and second handle flaps, the handle flap includes at least one fold line;

the fold line of the first handle flap extends obliquely with respect to the edge of the first handle flap; and the fold line of the second handle flap extends obliquely with respect to the edge of the second handle flap.

35. The blank according to claim 34, wherein:

an end of the fold line of the first handle flap is contiguous with the edge of the first handle flap; and an end of the fold line of the second handle flap is contiguous with the edge of the second handle flap.

36. The blank according to claim 30, further comprising a fifth panel having first and second longitudinal edges that are laterally spaced apart from one another, wherein the second longitudinal edge of the fourth panel is connected at a fold line to the first longitudinal edge of the fifth panel, the fifth panel includes at least third and fourth handle flaps that each have an edge, and the edges of the third and fourth handle flaps are adjacent to one another.

37. A carton formed from the blank according to claim 36, wherein:

predetermined portions of the fourth and fifth panels are in an overlapping relationship with respect to one another, the carton includes a multi-ply handle that is at least partially defined by the predetermined portions of the fourth and fifth panels that are in an overlapping relationship with respect to one another, the multi-ply handle includes opposite first and second sides;

the first and second handle flaps are adjacent the first side of the multi-ply handle; and the third and fourth handle flaps are adjacent the second side of the multi-ply handle.

38. The blank according to claim 30, wherein each of the first and second fold lines is not collinear with either of the first and second longitudinal edges of the first panel.

39. A blank for forming a carton, the blank comprising:

a first panel having first and second longitudinal edges that are laterally spaced apart from one another, wherein the first panel includes (a) at least first and second handle flaps that each have an edge, and the edges of the first and second handle flaps are adjacent to one another, (b) a handle, and each of the first and second handle flaps is adjacent the handle;

a second panel having first and second longitudinal edges that are laterally spaced apart from one another, wherein the second longitudinal edge of the first panel is connected at a fold line to the first longitudinal edge of the second panel;

a third panel having first and second longitudinal edges that are laterally spaced apart from one another, wherein the second longitudinal edge of the second panel is connected at a fold line to the first longitudinal edge of the third panel;

a fourth panel having first and second longitudinal edges that are laterally spaced apart from one another, wherein the second longitudinal edge of the third panel is connected at a fold line to the first longitudinal edge of the fourth panel;

a fifth panel having first and second longitudinal edges that are laterally spaced apart from one another, wherein the second longitudinal edge of the fourth panel is connected at a fold line to the first longitudinal edge of the fifth panel, the fifth panel includes at least third and fourth handle flaps that each have an edge, and the edges of the third and fourth handle flaps are adjacent to one another;

a sixth panel having first and second longitudinal edges that are laterally spaced apart from one another, wherein the second longitudinal edge of the fifth panel is connected at a fold line to the first longitudinal edge of the sixth panel; and an opening in the blank, wherein the fold line which connects the fifth and sixth panels together is divided into two parts by the opening in the blank, the first panel includes first and second lateral edges that are longitudinally spaced apart from one another and respectively have end panels foldably connected thereto, the second panel includes first and second lateral edges that are longitudinally spaced apart from one another and respectively have end panels foldably connected thereto, the third panel includes first and second lateral edges that are longitudinally spaced apart from one another and respectively have end panels foldably connected thereto, the fourth panel includes first and second lateral edges that are longitudinally spaced apart from one another and respectively have end panels foldably connected thereto, and the fifth panel includes first and second lateral edges that are longitudinally spaced apart from one another and respectively have end panels foldably connected thereto.

40. A blank for forming a carton, the blank comprising:

a plurality of panels that are respectively foldably connected to one another for being erected into the carton, wherein the plurality of panels includes at least a first panel;

the first panel includes first and second peripheral edges that are opposite one another, third and fourth peripheral edges that are opposite one another, and at least first, second and third lines that together at least partially define at least first and second handle flaps that each have an edge;

none of the first, second and third lines is contiguous with any of the first, second, third and fourth peripheral edges of the first panel;

the edges of the first and second handle flaps are adjacent to one another;

the first and second handle flaps are positioned between the second and third lines;

each of the first, second and third lines is selected from the group consisting of a tear line, a slit, and a combination of a tear line and a slit, so that each of the first, second and third lines is adapted for there being a complete separation therealong;

a first end of the first line is proximate an intermediate portion of the second line;

a second end of the first line is proximate an intermediate portion of the third line;

the first line extends between the second and third lines so that the first line defines the edges of the first and second handle flaps, the first and second handle flaps together have an overall length that extends in a longitudinal direction, with the second and third lines extending in the longitudinal direction, the first and second handle flaps each have a width that extends in a lateral direction that is crosswise with respect to the longitudinal direction, with the first line extending in the lateral direction, and the overall length is greater than the width, so that the first line is shorter than each of the second line and the third line.

41. The blank according to claim 40, wherein:

the second line comprises a tear line; and the third line comprises a tear line.

42. The blank according to claim 40, wherein:

the first handle flap includes at least a first fold line that is not collinear with any of the first, second, third and fourth peripheral edges of the first panel, the first fold line includes a first end that is proximate the second line, the first fold line includes a second end that is proximate the third line the second handle flap includes at least a second fold line that is not collinear with any of the first, second, third and fourth peripheral edges of the first panel, the second fold line includes a first end that is proximate the second line, and the second fold line includes a second end that is proximate the third line.

43. The blank according to claim 42, wherein:

the first handle flap includes a third fold line that is not collinear with any of the first, second, third and fourth peripheral edges of the first panel, the third fold line is positioned between the first fold line and the edge of the first handle flap, the third fold line includes a first end that is proximate the second line, the third fold line includes a second end that is proximate the third line the second handle flap includes a fourth fold line that is not collinear with any of the first, second, third and fourth peripheral edges of the first panel, the fourth fold line is positioned between the second fold line and the edge of the second handle flap, the fourth fold line includes a first end that is proximate the second line, and the fourth fold line includes a second end that is proximate the third line.

44. The blank according to claim 40, wherein:

each line of the second and third lines includes opposite first and second ends, the first end of the second line is closer to the first end of the third line than to the second end of the third line, at least a fourth line extends from proximate the first end of the second line to proximate the first end of the third line, the fourth line is not collinear with any of the first, second, third and fourth peripheral edges of the first panel, at least a fifth line extends from proximate the second end of the second line to proximate the second end of the third line, and the fifth line is not collinear with any of the first, second, third and fourth peripheral edges of the first panel.

45. The blank according to claim 44, wherein the fourth line is a fold line and the fifth line is a fold line.

46. The blank according to claim 44, wherein the fourth line is an arcuate score line and the fifth line is an arcuate score line.

47. The blank according to claim 44, wherein:

a sixth line extends from proximate the first end of the second line to proximate the first end of the third line, at least a portion of the sixth line is positioned between the first line and the fourth line, a seventh line extends from proximate the second end of the second line to proximate the second end of the third line, and at least a portion of the seventh line is positioned between the first line and the fifth line.

48. The blank according to claim 40, wherein:

the first and second peripheral edges of the first panel respectively are first and second longitudinal edges that extend in a longitudinal direction and are laterally spaced apart from one another;

each of the second and third lines extends in the longitudinal direction; and the plurality of panels further includes a second panel having first and second longitudinal edges that extend in the longitudinal direction and are laterally spaced apart from one another, and the second longitudinal edge of the first panel is connected at a fold line to the first longitudinal edge of the second panel, and a third panel having first and second longitudinal edges that extend in the longitudinal direction and are laterally spaced apart from one another, and the second longitudinal edge of the second panel is connected at a fold line to the first longitudinal edge of the third panel.

49. The blank according to claim 48, wherein:

the plurality of panels further includes a fourth panel having first and second longitudinal edges that extend in the longitudinal direction and are laterally spaced apart from one another, the second longitudinal edge of the third panel is connected at a fold line to the first longitudinal edge of the fourth panel, and each of the second and third lines extends parallel to each of the first and second longitudinal edges of the first panel.

* * * * *